US006651839B2

(12) United States Patent
Kriebel et al.

(10) Patent No.: US 6,651,839 B2
(45) Date of Patent: Nov. 25, 2003

(54) DEVICE FOR HOT DISPERSING FIBROUS PAPER STOCK AND A METHOD HOT DISPERSING THE STOCK

(75) Inventors: Almut Kriebel, Weingarten (DE); Volker Niggl, Weingarten (DE); Josef Schneid, Vogt (DE); Hans Schnell, Mengen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/050,138

(22) Filed: Jan. 18, 2002

(65) Prior Publication Data

US 2002/0112826 A1 Aug. 22, 2002

(30) Foreign Application Priority Data

Jan. 19, 2001 (DE) ..... 101 02 449

(51) Int. Cl.[7] ..... B65G 59/00

(52) U.S. Cl. ..... 221/1; 241/18

(58) Field of Search ..... 221/1, 135, 278, 221/277; 241/15, 18, 17, 23, 30

(56) References Cited

U.S. PATENT DOCUMENTS

| | | | |
|---|---|---|---|
| 1,795,603 | A | 3/1931 | Hussey |
| 3,285,163 | A | 11/1966 | Burner |
| 3,585,924 | A | 6/1971 | Nolan |
| 3,661,328 | A | 5/1972 | Leask |
| 3,671,019 | A | 6/1972 | Tapscott et al. |
| 3,765,611 | A | 10/1973 | Steiniger |
| 3,765,613 | A | 10/1973 | Steiniger |
| 3,847,363 | A | 11/1974 | Reinhall |
| 3,910,505 | A | 10/1975 | Reinhall |

(List continued on next page.)

FOREIGN PATENT DOCUMENTS

| | | |
|---|---|---|
| CA | 1050317 | 3/1979 |
| DE | 1806612 | 5/1970 |
| DE | 1761864 | 9/1971 |
| DE | 2660362 | 6/1980 |
| DE | 19523704 | 1/1997 |
| DE | 19712653 | 10/1998 |
| FR | 2224591 | 10/1974 |
| GB | 548271 | 10/1942 |
| WO | 83/02788 | 8/1983 |
| WO | 96/18769 | 6/1996 |

*Primary Examiner*—Kenneth W. Noland
(74) *Attorney, Agent, or Firm*—Greenblum & Bernstein, P.L.C.

(57) ABSTRACT

A method and a dispersing machine for hot dispersing a highly consistent fibrous stock. The machine includes at least one stationary stator that includes a plurality of annular concentric rows of stator teeth. At least one rotating rotor is provided that includes a plurality of annular concentric rows of rotor teeth. An annular dispersing zone is formed by the stator teeth and the rotor teeth whereby the rotor teeth are adapted to rotate adjacent the stator teeth such that a distance is maintained between the stator teeth and the rotor teeth in the annular dispersion zone. An inlet is provided that allows the fibrous stock to enter the dispersion machine. A milling element is centrally arranged on the rotor. The milling element is arranged near the inlet and defines a milling zone. An annular chamber is arranged between the dispersion zone and the milling zone. At least one conduit allows a heating medium to enter the annular chamber. At least one rotatable annular centrifugal row of teeth is arranged between the milling element and the annular chamber. The method includes transporting the fibrous stock via the inlet to the milling zone, rotating the milling element to subject the fibrous stock to milling, allowing the fibrous stock to pass by the at least one rotatable annular centrifugal row of teeth, subjecting the fibrous stock to the heating medium in the annular chamber, and moving the fibrous stock through the dispersion zone.

37 Claims, 1 Drawing Sheet

U.S. PATENT DOCUMENTS

| | | | |
|---|---|---|---|
| 3,943,034 | A | 3/1976 | Wallén |
| 4,030,865 | A | 6/1977 | Kobayashi |
| 4,123,489 | A | 10/1978 | Kelley |
| 4,136,831 | A | 1/1979 | Cederquist et al. |
| 4,235,665 | A | 11/1980 | Reinhall et al. |
| 4,236,959 | A | 12/1980 | Reinhall |
| 4,270,552 | A | 6/1981 | Jenkins et al. |
| 4,283,252 | A | 8/1981 | Reinhall |
| 4,431,482 | A | 2/1984 | Heinbockel et al. |
| 4,676,440 | A | 6/1987 | Perkola |
| 4,909,900 | A | 3/1990 | Matzke et al. |
| 5,035,362 | A | 7/1991 | Mazurkiewicz |
| 5,478,441 | A | 12/1995 | Hamilton |
| 5,498,766 | A | 3/1996 | Stuart et al. |
| 5,518,580 | A | 5/1996 | Ortner et al. |
| 5,727,743 | A | 3/1998 | Schneid et al. |
| 5,730,376 | A | 3/1998 | Schneid et al. |
| 6,073,865 | A | 6/2000 | Kriebel et al. |
| 6,250,573 | B1 | 6/2001 | Kriebel et al. |

DEVICE FOR HOT DISPERSING FIBROUS PAPER STOCK AND A METHOD HOT DISPERSING THE STOCK

CROSS-REFERENCE TO RELATED APPLICATIONS

The present application claims priority under 35 U.S.C. §119 of German Patent Application No. DE 101 02 449.5, filed on Jan. 19, 2001, the disclosure of which is expressly incorporated by reference herein in its entirety.

BACKGROUND OF THE INVENTION

1. Field of the Invention

The invention relates to a device for hot dispersing fibrous paper stock and a method of dispersing the stock with the device.

2. Discussion of Background Information

Devices of the above-mentioned type are used, for example, for improving the quality of fibrous stock made from recovered paper. It is known that fibrous paper stock can be homogenized by dispersion and thereby be significantly improved. Here, frequently, a fibrous scrap stock is processed having a dry matter content between 15 and 35% and brought to a temperature that is much higher than the ambient temperature. The heating necessary for this may occur by the direct addition of steam between the dispersing armaments as shown in DE 197 12 653 A1, the disclosure of which is expressly incorporated by reference in its entirety. The advantage of this measure already known is that the milling, heating, and dispersing of the scrap stock can occur in a single device. However, problems may arise if the scrap stock is not fine enough for quick heating, even in an armament.

SUMMARY OF THE INVENTION

The invention provides for a process in which it is possible to shorten the heating times even more and/or to further raise the stock temperature.

The invention provides for a dispersing machine for hot dispersing a highly consistent fibrous stock comprising at least one stationary stator that includes a plurality of annular concentric rows of stator teeth. At least one rotating rotor is provided that includes a plurality of annular concentric rows of rotor teeth. An annular dispersing zone is formed by the stator teeth and the rotor teeth whereby the rotor teeth are adapted to rotate adjacent the stator teeth such that a distance is maintained between the stator teeth and the rotor teeth in the annular dispersion zone. An inlet is provided that allows the fibrous stock to enter the dispersion machine. A milling element is centrally arranged on the rotor. The milling element is arranged near the inlet and defines a milling zone. An annular chamber is arranged between the dispersion zone and the milling zone. At least one conduit allows a heating medium to enter the annular chamber. At least one rotatable annular centrifugal row of teeth is arranged between the milling element and the annular chamber.

The fibrous stock may be a fibrous paper stock. The annular chamber may be arranged radially inwards of the dispersion zone. The at least one conduit may comprise a plurality of feeding pipes. The plurality of feeding pipes may be coupled to the stator. The heating medium may comprise a gaseous medium. The gaseous medium may comprise steam. The at least one rotatable annular centrifugal row of teeth may be adapted to rotate in a direction which is opposite to a direction of rotation of the rotor. The at least one rotatable annular centrifugal row of teeth may be adapted to rotate at a different speed than a rotational speed of the rotor. The at least one rotatable annular centrifugal row of teeth may be arranged between the milling zone and the annular chamber. The at least one rotatable annular centrifugal row of teeth may be arranged between the milling zone and the dispersion zone, the annular chamber being defined by an annular space between the at least one rotatable annular centrifugal row of teeth and the dispersion zone.

The at least one rotatable annular centrifugal row of teeth may be adapted to rotate in a different direction and at a different speed than a direction and rotational speed of the rotor. The at least one centrifugal row of teeth and the milling element may be rotatable in opposite rotational directions. A radially inner end of the dispersion zone may be defined by a radially inner row of rotor teeth. The stator may have no other rows of teeth other than those of the dispersion zone. The stator may have a planar surface that faces the annular chamber. The machine may further comprise a rotating feeding screw adapted to deliver the fibrous stock to the inlet. The machine may further comprise a carrier coupled to the at least one rotatable annular centrifugal row of teeth. The carrier may be rotatably mounted. The machine may further comprise a feed screw housing, wherein the carrier is rotatably mounted to the feed screw housing. The carrier may be adapted to be driven rotationally. The carrier may be rotatably mounted to a non-movable member. The non-movable member may comprise a feed screw housing. The carrier is one of rotatable with and connected to a feeding screw.

The invention also provides for a method of hot dispersing a highly consistent fibrous stock in a machine which comprises at least one stationary stator that includes a plurality of annular concentric rows of stator teeth, at least one rotating rotor that includes a plurality of annular concentric rows of rotor teeth, an annular dispersing zone being formed by the stator teeth and the rotor teeth whereby the rotor teeth are adapted to rotate adjacent the stator teeth such that a distance is maintained between the stator teeth and the rotor teeth in the annular dispersion zone, an inlet that allows the fibrous stock to enter the dispersion machine, a milling element centrally arranged on the rotor, the milling element being arranged near the inlet and defining a milling zone, an annular chamber arranged between the dispersion zone and the milling zone, at least one conduit allowing a heating medium to enter the annular chamber, and at least one rotatable annular centrifugal row of teeth arranged between the milling element and the annular chamber, the method comprising transporting the fibrous stock via the inlet to the milling zone, rotating the milling element to subject the fibrous stock to milling, allowing the fibrous stock to pass by the at least one rotatable annular centrifugal row of teeth, subjecting the fibrous stock to the heating medium in the annular chamber, and moving the fibrous stock through the dispersion zone.

The fibrous stock may be a fibrous paper stock. The annular chamber may be arranged radially inwards of the dispersion zone. The at least one conduit may comprise a plurality of feeding pipes. The plurality of feeding pipes may be coupled to the stator. The heating medium may comprise a gaseous medium. The gaseous medium may comprise steam. The at least one rotatable annular centrifugal row of teeth may be adapted to rotate in a direction which is opposite to a direction of rotation of the rotor. The at least one rotatable annular centrifugal row of teeth may be adapted to rotate at a different speed than a rotational speed of the rotor. The at least one rotatable annular centrifugal row of teeth may be arranged between the milling zone and the annular chamber. The at least one rotatable annular centrifugal row of teeth may be arranged between the milling zone and the dispersion zone, the annular chamber being defined by an annular space between the at least one rotatable annular centrifugal row of teeth and the dispersion zone. The at least one rotatable annular centrifugal row of teeth may be adapted to rotate in a different direction and at a different speed than a direction and rotational speed of the rotor.

The invention further provides for a dispersing machine for hot dispersing a highly consistent fibrous stock comprising at least one stationary stator that includes a plurality of annular concentric rows of stator teeth. At least one rotating rotor is provided that includes a plurality of annular concentric rows of rotor teeth. An annular dispersing zone is formed by the stator teeth and the rotor teeth whereby the rotor teeth are adapted to rotate adjacent the stator teeth such that a distance is maintained between the stator teeth and the rotor teeth in the annular dispersion zone. A feeding screw housing has an inlet that allows the fibrous stock to enter the dispersion machine. A milling element is centrally arranged on the rotor, the milling element being arranged near the inlet. An annular chamber is arranged between the dispersion zone and the milling element. A plurality of conduits are coupled to the stator for allowing a heating medium to enter the annular chamber. A rotatable carrier has at least one annular centrifugal row of teeth, whereby the at least one rotatable annular centrifugal row of teeth are arranged between the milling element and the annular chamber. The rotatable carrier is rotatably mounted to the feeding screw housing.

Utilizing this process it is possible to further mill the scrap stock in the armament so that it can be heated quickly.

The highly consistent fibrous paper stock can be inserted directly into the armament of the dispersing machine either as a compressed plug or by way of a loose, only pre-milled highly consistent stock. In both cases, the stock is then collected by the first milling stage of the dispersing rotor in the flow direction, and spun outwards radially, creating small fibrous scraps. According to the invention, it then hits a rotating centrifugal toothed wheel that, although it rotates, is not part of the dispersing rotor. This centrifugal toothed wheel defines the steam chamber radially inward, therefore, when the dispersing machine is in operation, the gaps between the teeth are largely filled with stock. After the stock enters the steam chamber, it is heated to the required temperature by introducing steam; a short heating time is sufficient due to the intense prior milling. The undesired compacting of the fibrous stock between the stationary channels is avoided. The dispersing itself, i.e., the modification of the characteristics of the stock, occurs in the dispersing zone following downstream of the steam chamber.

Other exemplary embodiments and advantages of the present invention may be ascertained by reviewing the present disclosure and the accompanying drawing.

Finally, the invention is related to the subject matter disclosed in U.S. Pat. No. 6,250,573, the disclosure of which is expressly incorporated by reference in its entirety.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
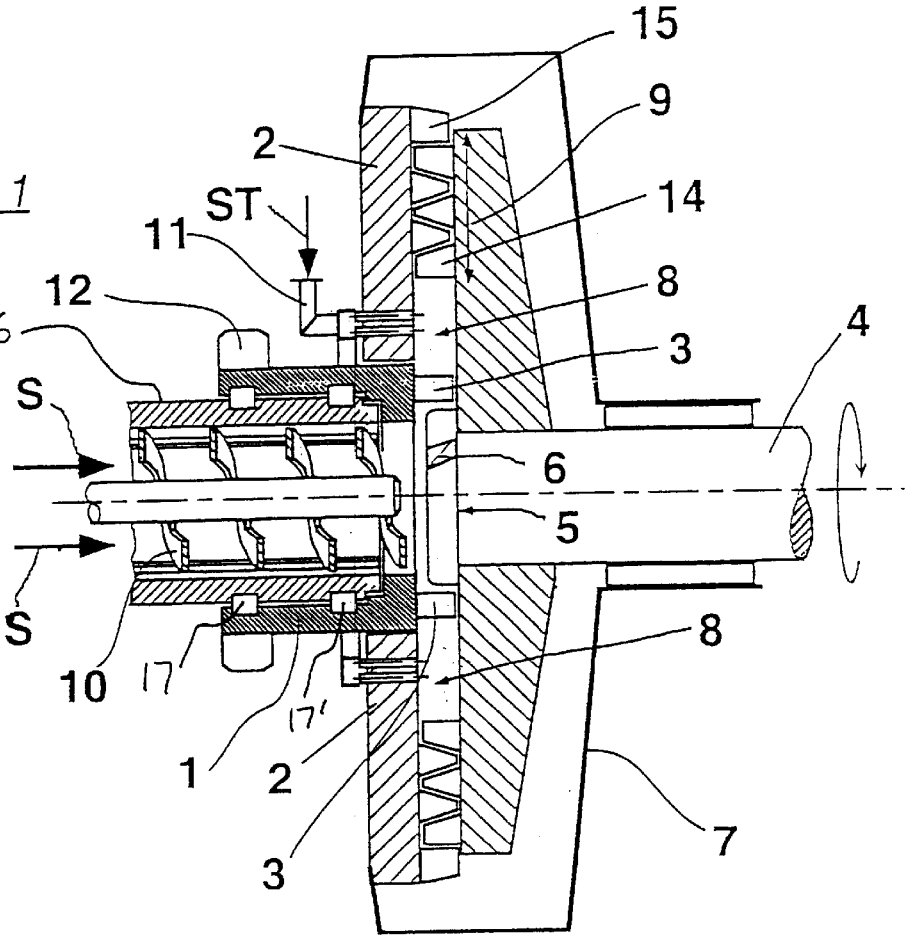
FIG. 1 shows a cross section through a dispersing machine according to the invention.

FIG. 1 shows a dispersing machine embodied according to the invention. The machine is designed to allow a highly consistent fibrous paper stock S to be added when it is in a more or less loose form. Such pre-milled stock is obtained, e.g., when a thickening has occurred on a wire press. This thickened fibrous paper stock exits as a moist web, as is known. After a subsequent crushing of this moist web, e.g., using a shredding screw (not shown), the stock is pre-milled. Before entering the dispersing machine, it is collected by a feeding screw 10 and immediately fed into a central inlet of the dispersing machine.

A milling element 5 is arranged at a downstream end of the feeding screw 10 and is centrally located and/or mounted to a rotor 4. The milling element is in the form of, e.g., one or more milling rails 6, and may have the shape of wings or crosses. However, other shapes may also be utilized with leaving the scope of the invention. Arranged radially outwards from the milling element 5 is located a centrifligal row of teeth 3. This row of teeth 3 is disposed on and/or mounted to a carrier 1 which is rotatably mounted via, e.g., bearings 17 and 17' or bushings, to and/or about a feed screw housing 16. The milling rails 6 are designed to press the stock S between the teeth 3 and these teeth 3 allow the stock to exit or pass between gaps formed between the teeth 3. As a result, the stock S is not compressed too much. After the stock S passes through the teeth 3, it enters a steam chamber wherein the stock S which is designed to heat the stock S. In order to keep the heating time in the steam chamber 8 short, it is advantageous to mill the stock S to the size of pinholes.

The steam chamber 8 is essentially an annular chamber and is designed without any teeth that produce mechanical dispersion. A heating steam ST is fed to the steam chamber 8 via one or more steam pipes 11 which are connected and/or coupled to an outer side of a stator 2. As a result if this design, the heating steam ST can be brought into contact with the fibrous stock S in the steam chamber 8. This configuration is such that the fibrous stock S is swirled in the steam chamber 8 or at least kept in a loose state to the extent that it can easily be penetrated by the heated steam ST. The heating of the stock S essentially occurs by a condensation of the steam. In this regard, the steam may be continuously added to the steam chamber 8. This feeding of the steam ST also improves the swirling and the loosening of the fine fibrous stock scraps.

The invention takes advantage of the fact that it is known that dispersing caused by teeth which closely pass each other at a relatively high speed subject the fibrous stock located between them to strong shear forces. In this regard, a dispersing zone 9 is provided radially outwards from the steam chamber 8. This dispersion zone 9 accordingly functions in a known manner to perform the dispersion function. The invention utilizes three circularly positioned rows of teeth 14 which may be a part of the rotor 4 or which may be coupled and/or mounted thereto. Three circularly positioned rows of teeth 15 are arranged on the stator 2 and these teeth 15 may similarly be part of the stator or they may be coupled and/or mounted thereto. The rows of teeth 14 and 15 mesh axially without touching. As can be seen in FIG. 1, the first radially inner row of teeth 14 of the dispersion zone 9 are those of the rotor 4 and the last radially outermost teeth 15 of the dispersion zone 9 are those of the stator 2.

With this arrangement, high circumferential speeds of the dispersing zone teeth are possible and such is advantageous in the dispersing zone 9. On the other hand, the milling rails 6 which are located radially inward from the dispersion zone 9 are slower and, thus, mill the arriving scrap stock S gently. After the stock S passes the dispersion zone 9, the dispersed fibrous stock S exits radially outwards to the housing 7.

Overall, the dispersing machine according to the invention provides high effectiveness in a limited space. Accordingly, the invention provides for a very compact device. Of course, the size of the steam chamber 8 must be selected such that the scrap stock S in it has the require dwell time for proper heating. It has been found that a range of about 1 to 2 seconds dwell time is often necessary; however, this time depends on the desired temperature as well as on the fineness of the scrap stock S.

As discussed above, the carrier 1 includes a centrifugal row of teeth 3 which engage the stock S. However, a part the carrier 1 is arranged outside on the feed screw housing 16. According to the embodiment shown in FIG. 1, this carrier 1 can be driven and/or rotated via, e.g., a belt or by a toothed wheel or gear 12. However, other mechanisms can be utilized to drive the carrier 1, including those which are conventional or otherwise. Moreover, the carrier 1 can also be coupled and/or connected to the feeding screw 10 so as to be rotatable therewith (not shown). In such an arrangement, the carrier 1 could also serve as the secondary support or bearing of the feeding screw 10 (not shown).

Figure 2:
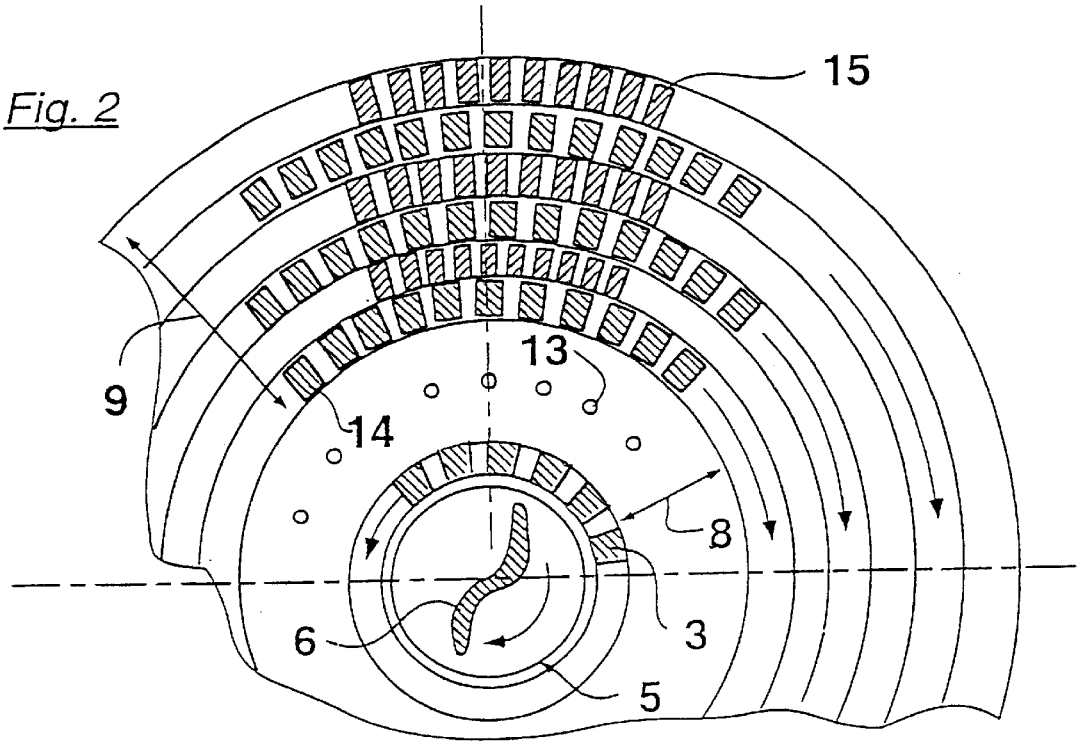
FIG. 2 shows a schematic representation of a dispersing armament in a plan view.

In FIG. 2 shows a partial plan view of the rotor 4, the teeth 15 of the stator 2 and a partial view the stator 2. It is discernible in this figure that the dispersing zone 9 is provided with three rows of teeth 14 which belong to the rotor 4 and three rows of teeth 15 which belong to the stator 2. As mentioned above, the radially inner first row of teeth 14 of the dispersing zone 9 are attached to the rotor 4 so as to rotate therewith and the radially outermost teeth 15 are attached to the stator 2. Such dispersing zones are known per se from, e.g., U.S. Pat. No. 6,250,573 which has been expressly incorporated by reference in its entirety, accordingly it is not described in detail. The important thing is that the teeth 14 and 15 pass each other at a certain distance (i.e., the teeth 14 are separated by a gap from the teeth 15) which is approximately 0.2 to approximately 0.3 mm. The intention of such an arrangement is not to subject the paper fibers to cutting, as typically occurs in, e.g., refining mills, and such is hardly possible in such a configuration.

As noted above, the steam chamber 8 is positioned radially inwards of the dispersing zone 9. This steam chamber 8 is provided with a plurality of steam feeding apertures 13 that are formed in the stator 2, and which are each connected to a steam pipe 11, as shown in FIG. 1. As can be seen in FIG. 2, the centrifugal row of teeth 3 define the radially inner end of the steam chamber 8. According to a preferred embodiment, it is advantageous for this centrifugal row of teeth 3 to be moved and/or rotated in a direction (counterclockwise) that is opposite the direction (clockwise) of rotation of the rotor 4, as illustrated by the arrows in FIG. 2. However, these rotations may be reversed so that the teeth 3 rotate clockwise while the rotor 4 rotates counterclockwise. Arranged in the center of the rotor 4 is the milling element 5 which has the wing-shaped milling rails 6. The milling element 5 may of course be form as a part of the rotor 4 as is common. However, it may alternatively be formed separately and thereafter be coupled and/or attached to the rotor 4 by any connecting mechanism, conventional or otherwise, such as by, e.g., welding.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A dispersing machine for hot dispersing a highly consistent fibrous stock comprising:

at least one stationary stator that includes a plurality of annular concentric rows of stator teeth;

at least one rotating rotor that includes a plurality of annular concentric rows of rotor teeth;

an annular dispersing zone being formed by the stator teeth and the rotor teeth whereby the rotor teeth are adapted to rotate adjacent the stator teeth such that a distance is maintained between the stator teeth and the rotor teeth in the annular dispersion zone;

an inlet that allows the fibrous stock to enter the dispersion machine;

a milling element centrally arranged on the rotor, the milling element being arranged near the inlet and defining a milling zone;

an annular chamber arranged between the dispersion zone and the milling zone;

at least one conduit allowing a heating medium to enter the annular chamber; and at least one rotatable annular centrifugal row of teeth arranged between the milling element and the annular chamber.

2. The machine of claim 1, wherein the fibrous stock is a fibrous paper stock.

3. The machine of claim 1, wherein the annular chamber is arranged radially inwards of the dispersion zone.

4. The machine of claim 1, wherein the at least one conduit comprises a plurality of feeding pipes.

5. The machine of claim 4, wherein the plurality of feeding pipes are coupled to the stator.

6. The machine of claim 1, wherein the heating medium comprises a gaseous medium.

7. The machine of claim 6, wherein the gaseous medium comprises steam.

8. The machine of claim 1, wherein the at least one rotatable annular centrifugal row of teeth is adapted to rotate in a direction which is opposite to a direction of rotation of the rotor.

9. The machine of claim 1, wherein the at least one rotatable annular centrifugal row of teeth is adapted to rotate at a different speed than a rotational speed of the rotor.

10. The machine of claim 1, wherein the at least one rotatable annular centrifugal row of teeth is arranged between the milling zone and the annular chamber.

11. The machine of claim 1, wherein the at least one rotatable annular centrifugal row of teeth is arranged between the milling zone and the dispersion zone, the annular chamber being defined by an annular space between the at least one rotatable annular centrifugal row of teeth and the dispersion zone.

12. The machine of claim 1, wherein the at least one rotatable annular centrifugal row of teeth is adapted to rotate in a different direction and at a different speed than a direction and rotational speed of the rotor.

13. The machine of claim 1, wherein the at least one centrifugal row of teeth and the milling element are rotatable in opposite rotational directions.

14. The machine of claim 1, wherein a radially inner end of the dispersion zone is defined by a radially inner row of rotor teeth.

15. The machine of claim 1, wherein the stator has no other rows of teeth other than those of the dispersion zone.

16. The machine of claim 1, wherein the stator has a planar surface that faces the annular chamber.

17. The machine of claim 1, further comprising a rotating feeding screw adapted to deliver the fibrous stock to the inlet.

18. The machine of claim 1, further comprising a carrier coupled to the at least one rotatable annular centrifugal row of teeth.

19. The machine of claim 18, wherein the carrier is rotatably mounted.

20. The machine of claim 19, further comprising a feed screw housing, wherein the carrier is rotatably mounted to the feed screw housing.

21. The machine of claim 20, wherein the carrier is adapted to be driven rotationally.

22. The machine of claim 19, wherein the carrier is rotatably mounted to a non-movable member.

23. The machine of claim 22, wherein the non-movable member comprises a feed screw housing.

24. The machine of claim 19, wherein the carrier is one of rotatable with and connected to a feeding screw.

25. A method of hot dispersing a highly consistent fibrous stock in a machine which comprises at least one stationary stator that includes a plurality of annular concentric rows of stator teeth, at least one rotating rotor that includes a plurality of annular concentric rows of rotor teeth, an annular dispersing zone being formed by the stator teeth and the rotor teeth whereby the rotor teeth are adapted to rotate adjacent the stator teeth such that a distance is maintained between the stator teeth and the rotor teeth in the annular dispersion zone, an inlet that allows the fibrous stock to enter the dispersion machine, a milling element centrally arranged on the rotor, the milling element being arranged near the inlet and defining a milling zone, an annular chamber arranged between the dispersion zone and the milling zone, at least one conduit allowing a heating medium to enter the annular chamber, and at least one rotatable annular centrifugal row of teeth arranged between the milling element and the annular chamber, the method comprising:

transporting the fibrous stock via the inlet to the milling zone;

rotating the milling element to subject the fibrous stock to milling;

allowing the fibrous stock to pass by the at least one rotatable annular centrifugal row of teeth;

subjecting the fibrous stock to the heating medium in the annular chamber; and moving the fibrous stock through the dispersion zone.

26. The method of claim 25, wherein the fibrous stock is a fibrous paper stock.

27. The method of claim 25, wherein the annular chamber is arranged radially inwards of the dispersion zone.

28. The method of claim 25, wherein the at least one conduit comprises a plurality of feeding pipes.

29. The method of claim 28, wherein the plurality of feeding pipes are coupled to the stator.

30. The method of claim 25, wherein the heating medium comprises a gaseous medium.

31. The method of claim 30, wherein the gaseous medium comprises steam.

32. The method of claim 25, wherein the at least one rotatable annular centrifugal row of teeth is adapted to rotate in a direction which is opposite to a direction of rotation of the rotor.

33. The method of claim 25, wherein the at least one rotatable annular centrifugal row of teeth is adapted to rotate at a different speed than a rotational speed of the rotor.

34. The method of claim 25, wherein at least one rotatable annular centrifugal row of teeth is arranged between the milling zone and the annular chamber.

35. The method of claim 25, wherein the at least one rotatable annular centrifugal row of teeth is arranged between the milling zone and the dispersion zone, the annular chamber being defined by an annular space between the at least one rotatable annular centrifugal row of teeth and the dispersion zone.

36. The method of claim 25, wherein the at least one rotatable annular centrifugal row of teeth is adapted to rotate in a different direction and at a different speed than a direction and rotational speed of the rotor.

37. A dispersing machine for hot dispersing a highly consistent fibrous stock comprising:

at least one stationary stator that includes a plurality of annular concentric rows of stator teeth;

at least one rotating rotor that includes a plurality of annular concentric rows of rotor teeth;

an annular dispersing zone being formed by the stator teeth and the rotor teeth whereby the rotor teeth are adapted to rotate adjacent the stator teeth such that a distance is maintained between the stator teeth and the rotor teeth in the annular dispersion zone;

a feeding screw housing having an inlet that allows the fibrous stock to enter the dispersion machine;

a milling element centrally arranged on the rotor, the milling element being arranged near the inlet;

an annular chamber arranged between the dispersion zone and the milling element;

a plurality of conduits coupled to the stator for allowing a heating medium to enter the annular chamber; and a rotatable carrier having at least one annular centrifugal row of teeth, whereby the at least one rotatable annular centrifugal row of teeth are arranged between the milling element and the annular chamber, wherein the rotatable carrier is rotatably mounted to the feeding screw housing.

* * * * *